US007967286B2

(12) United States Patent
Partridge et al.

(10) Patent No.: US 7,967,286 B2
(45) Date of Patent: Jun. 28, 2011

(54) SHEET STACKING TRAY ASSEMBLY WITH GEOMETRIC PROTUBERANCES

(75) Inventors: Colin Jon Partridge, Hertfordshire (GB); Michael George Snelling, Hertfordshire (GB); Ian Alan Parks, Herts (GB); Julia Allwright, London (GB)

(73) Assignee: Xerox Corporation, Norwalk, CT (US)

( * ) Notice: Subject to any disclaimer, the term of this patent is extended or adjusted under 35 U.S.C. 154(b) by 164 days.

(21) Appl. No.: 12/432,051

(22) Filed: Apr. 29, 2009

(65) Prior Publication Data

US 2010/0276869 A1 Nov. 4, 2010

(51) Int. Cl.
*B65H 1/08* (2006.01)

(52) U.S. Cl. ..... 271/145; 271/147

(58) Field of Classification Search ..... 271/145, 271/147, 126, 127, 22, 30.1, 128
See application file for complete search history.

(56) References Cited

U.S. PATENT DOCUMENTS

| | | | | |
|---|---|---|---|---|
| 5,480,247 | A | 1/1996 | Saikawa et al. | |
| 5,848,787 | A * | 12/1998 | Miki | 271/127 |
| 6,302,390 | B1 | 10/2001 | Clark et al. | |
| 6,939,068 | B2 * | 9/2005 | Rawlings et al. | 400/718 |
| 7,188,835 | B2 * | 3/2007 | Lee et al. | 271/147 |
| 2002/0000691 | A1 * | 1/2002 | Takai | 271/113 |
| 2008/0088080 | A1 * | 4/2008 | Liu et al. | 271/127 |

FOREIGN PATENT DOCUMENTS

GB 2259499 A 3/1993

* cited by examiner

*Primary Examiner* — David H Bollinger
(74) *Attorney, Agent, or Firm* — Pepper Hamilton LLP

(57) ABSTRACT

A sheet stacking tray assembly may include a tray having a lead surface and an elevate plate. The lead surface may include one or more first geometric protuberances. At least one edge of the elevate plate may include one or more second geometric protuberances that are complimentary to the first geometric protuberances. The lead surface may be configured to interlock with the edge of the elevate plate to form a support area for one or more sheets.

16 Claims, 5 Drawing Sheets

SHEET STACKING TRAY ASSEMBLY WITH GEOMETRIC PROTUBERANCES

CROSS REFERENCE TO RELATED APPLICATIONS

This application is related to U.S. patent application Ser. No. 12/431,949 filed Apr. 29, 2009.

Not Applicable

BACKGROUND

Sheet stacking tray assemblies are known in the art and described in, for example, U.S. Pat. No. 6,302,390 to Clark et al. Conventional sheet stacking tray assemblies include a lead edge that is a continuous surface against which a stack of paper is registered.

Conventional sheet stacking tray assemblies also typically include a pivotal elevate plate. A clearance usually exists between an elevate plate edge and the lead edge to allow for free movement of the elevate plate. However, this clearance tends to increase as the elevate plate is raised and sheets are fed from the top of the stack. When the last few pages of the stack are fed, it is common for one or more sheets to become trapped in the gap between the elevate plate and the lead edge of the tray. The trapped sheets may become damaged as the elevate plate descends to its original position. Trapped and/or damaged sheets are difficult to feed into the paper path and can cause paper jams. Paper jams, in turn, can frustrate customers and can reduce the overall feeding quality and capabilities of the machine.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Unless defined otherwise, all technical and scientific terms used herein have the same meanings as commonly understood by one of ordinary skill in the art. As used herein, the term "comprising" means "including, but not limited to."

In an embodiment, a sheet stacking tray assembly may include a tray having a lead surface and an elevate plate. The lead surface may include one or more first geometric protuberances. At least one edge of the elevate plate may include one or more second geometric protuberances that are complimentary to the first geometric protuberances. The lead surface may be configured to interlock with the edge of the elevate plate to form a support area for one or more sheets.

In an embodiment, a sheet stacking tray assembly may include a tray having a lead surface and an elevate plate. The lead surface may include one or more first geometric protuberances that extend from a first end of the lead surface to a second end of the lead surface. At least one edge of the elevate plate may include one or more second geometric protuberances that extend from a first end of the edge to a second end of the edge. The second geometric protuberances may be complimentary to the first protuberances. The lead surface may be configured to interlock with the edge to form a support area for one or more sheets.

BRIEF DESCRIPTION OF THE DRAWINGS

Aspects, features, benefits and advantages of the present invention will be apparent with regard to the following description and accompanying drawings, of which.

DETAILED DESCRIPTION

For purposes of the discussion below, a "resource" refers to a printer, a copier, a multifunction machine or system, a xerographic machine or system, or any other type of reproduction or printing apparatus that is capable of printing images on at least a portion of a sheet.

A "sheet" refers to a physical sheet of paper, plastic and/or other suitable substrate for printing images thereon.

A "sheet stack" refers to a plurality of sheets arranged vertically.

Figure 1:
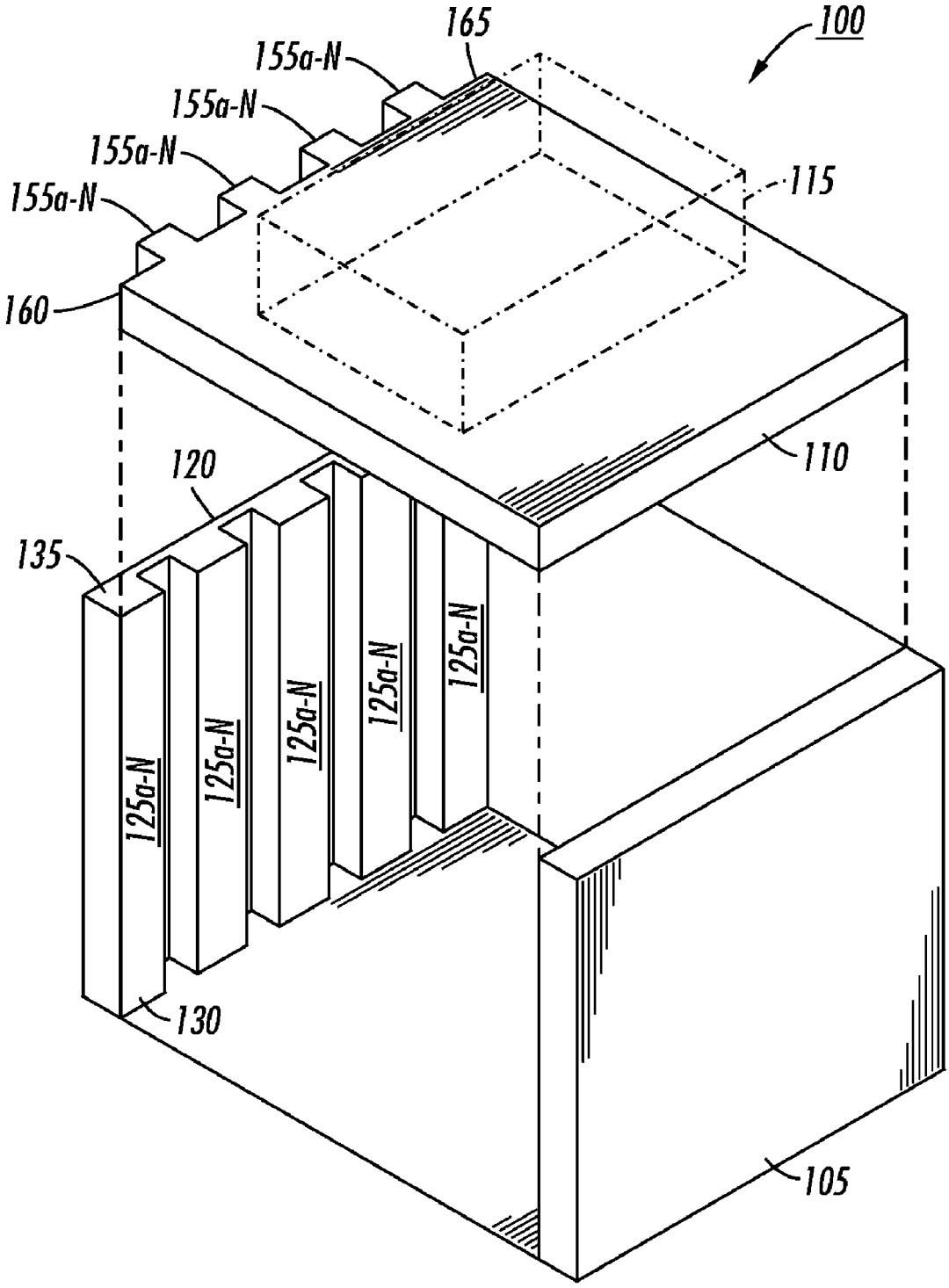
FIG. 1 illustrates an exemplary sheet stacking tray assembly according to an embodiment.

FIG. 1 illustrates an exemplary sheet stacking tray assembly 100 according to an embodiment. A sheet stacking tray assembly 100 may be a component of a resource. In an embodiment, the sheet stacking tray assembly 100 may be mounted in a slide-out paper drawer unit of a resource. For example, a slidable print tray may comprise a sheet stacking tray assembly 100 in a printer.

In an embodiment, a sheet stacking tray assembly 100 may comprise a tray 105 and an elevate plate 110. The elevate plate 110 may be located within the tray 105 as illustrated in FIG. 1. In an embodiment, a sheet stack 115 may be positioned on the elevate plate 110. The sheet stack 115 may be retained on the elevate plate 110 between a plurality of guides. For example, the sheet stack 115 may be retained between two side guides, a rear guide and a front guide. In an embodiment, the elevate plate 110 may move vertically relative to the tray 105 to engage the top of a sheet stack 115 with a sheet feeder.

Figure 2:
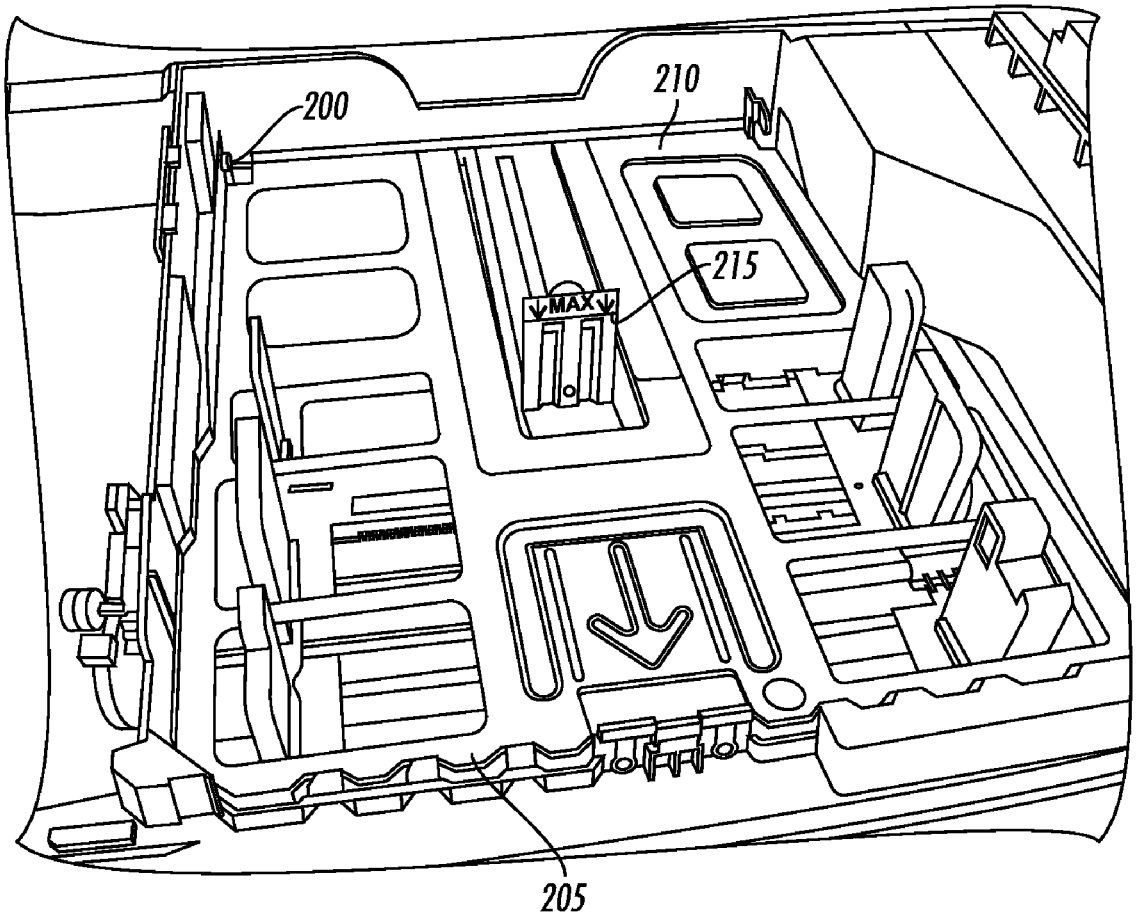
FIG. 2 illustrates an exemplary elevate plate according to an embodiment.

In an embodiment, the elevate plate 110 may pivot about a fastening element. The fastening element may connect the elevate plate 110 to the tray 105. In an embodiment, the fastening element may include a hinge, a screw and/or the like. FIG. 2 illustrates an exemplary elevate plate 110 according to an embodiment. As illustrated by FIG. 2, the elevate plate 110 may pivot about the fastening element 200.

Figure 3:
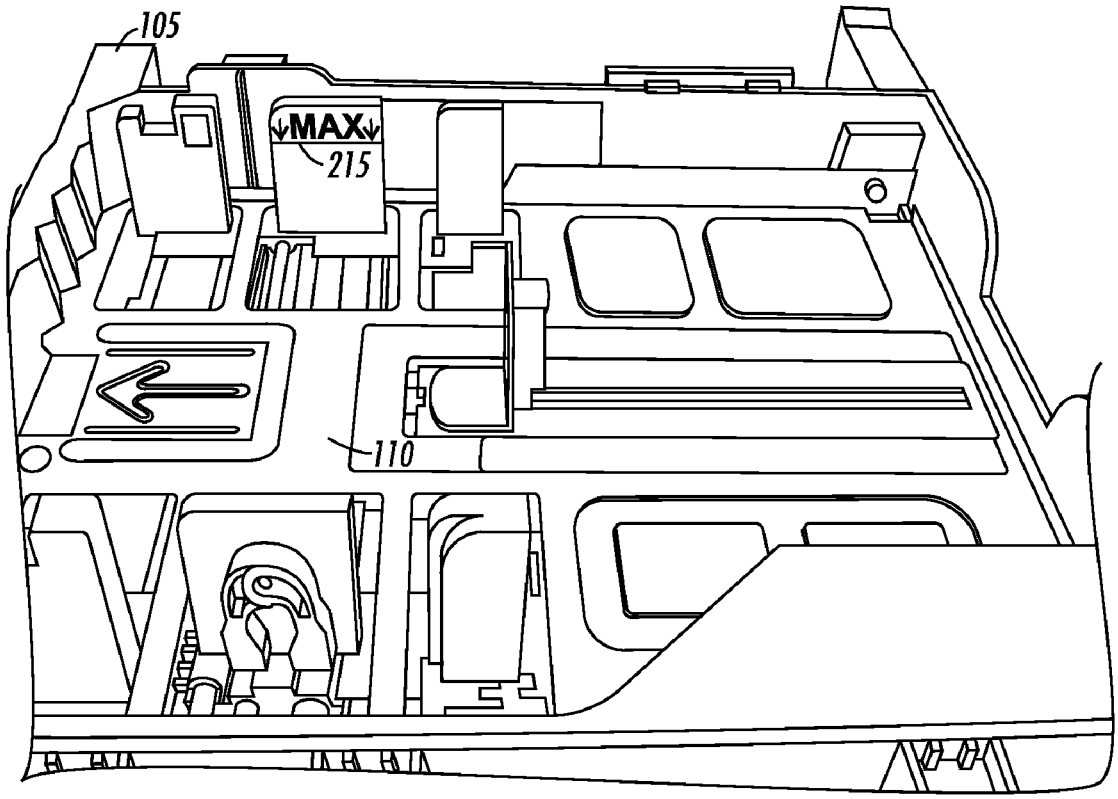
FIG. 3 illustrates an exemplary elevate plate according to an embodiment.

In an embodiment, when the tray assembly 100 is removed from a resource for loading, the elevate plate may descend until it comes into contact with a bottom portion of the tray 105. In an embodiment, as shown in FIG. 3, when a sheet stack substantially equals the maximum fill level 215 of the tray 105, the elevate plate 110 may be substantially level with the bottom of the tray.

After sheets are loaded in the tray assembly 100 and the tray assembly is returned to the resource, a sensor may be activated. In an embodiment, the sensor may transmit one or more instructions indicating that a sheet stack is available. In an embodiment, the elevate plate may be elevated. For example, as sheets from the sheet stack 115 are fed from the tray 105, the elevate plate 110 may upwardly pivot to engage the top sheet of the sheet stack 115 with a sheet feeder. As illustrated by FIG. 2, a first end 205 of the elevate plate 110 may be elevated higher than a second end 210 of the elevate plate. The first end 205 may be the end of the elevate plate 110 closest to the feeder, while the second end 210 of the elevate plate may be the end closest to the fastening element 200. In an embodiment, the elevate plate 110 may pivot until the first end 205 is substantially level with a top portion of a lead surface 120 of the tray 105.

Figure 4:
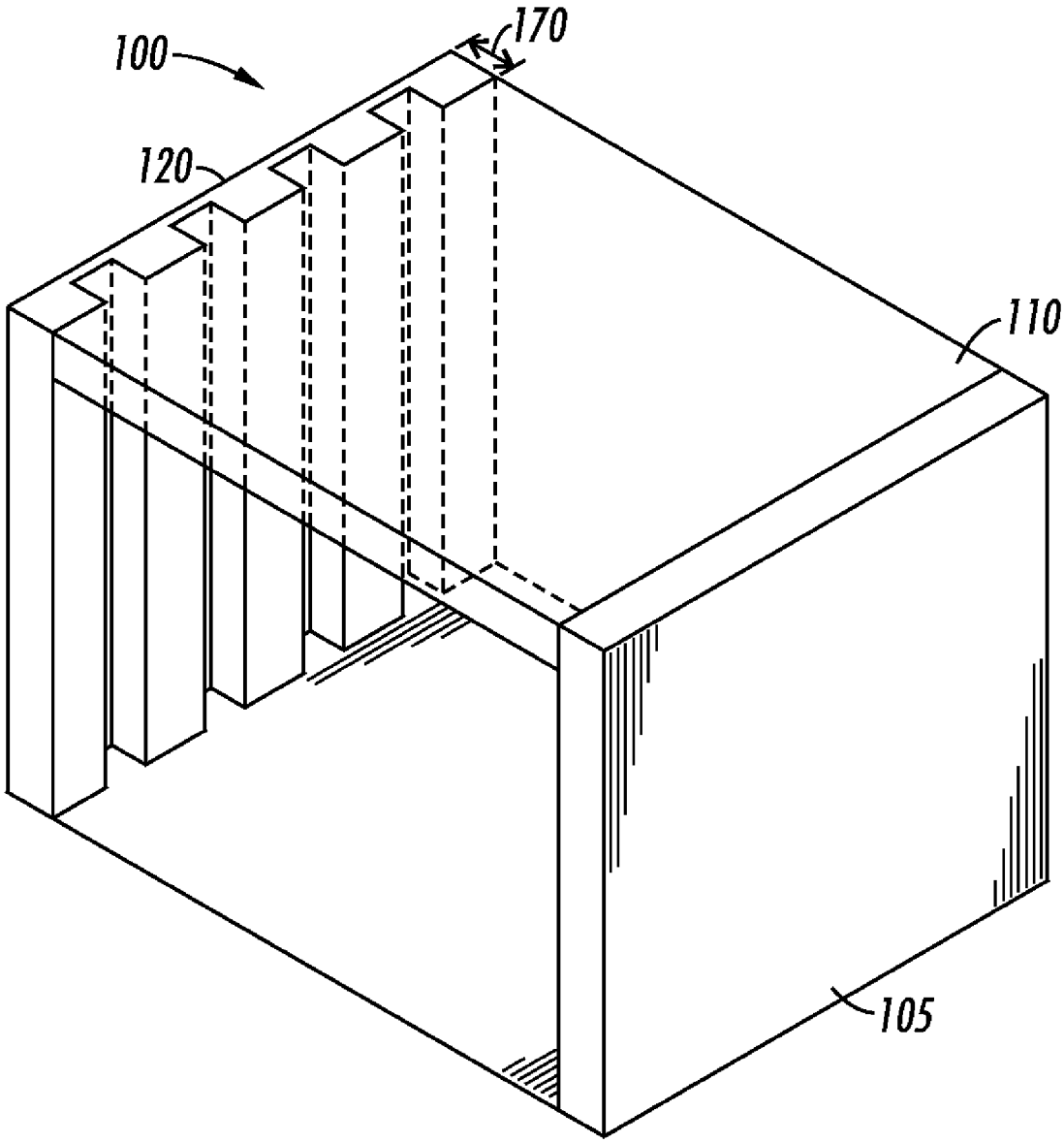
FIG. 4 illustrates an exemplary elevate plate according to an embodiment.

In an embodiment, the elevate plate 110 may raise and descend while remaining substantially parallel to the bottom of the tray 105. For example, the elevate plate 110 may not pivot to engage a lead surface 120, but rather may raise until the elevate plate is substantially level with a top portion of a lead surface as illustrated by FIG. 4.

In an embodiment, the elevate plate 110 may raise until a feed sensor is triggered. In an embodiment, a feed sensor may transmit one or more instructions that one or more sheets are ready to be fed. When a sufficient number of sheets have been fed from the elevate plate 110, the feed sensor may be deactivated. In an embodiment, the elevate plate 110 may be raised until the feed sensor is re-triggered.

In an embodiment, a lead surface 120 may be a surface of the tray 105 that is located between a feeder and the elevate plate 110. The lead surface 120 may facilitate the movement of the top sheet of the sheet stack 115 from the elevate plate 110 to the feeder. In an embodiment, the lead surface 120 may have one or more geometric protuberances 125*a*-N. The protuberances 125*a*-N may be square, triangular, circular and/or the like. For example, the lead surface 120 may have a castellated configuration as illustrated by FIG. 1. In an embodiment, the size of a protuberance 125*a*-N may be substantially identical to the size of each of the other protuberances. In an alternate embodiment, the size of a protuberance, such as 125*a*, may differ from one or more of the other protuberances.

In an embodiment, the protuberances 125*a*-N may extend from a first end 130 of the lead surface 120 to a second end 135 of the lead surface as illustrated by FIG. 1. The first end 130 may be considered the bottom end of the lead surface 120, while the second end 135 may be considered the top end of the lead surface. Alternatively, the protuberances 125*a*-N may cover only a portion of the lead surface 120. For example, the protuberances 125*a*-N may cover a portion of the lead surface 120 that is less than the entire depth 145 of the lead surface.

Figure 5:
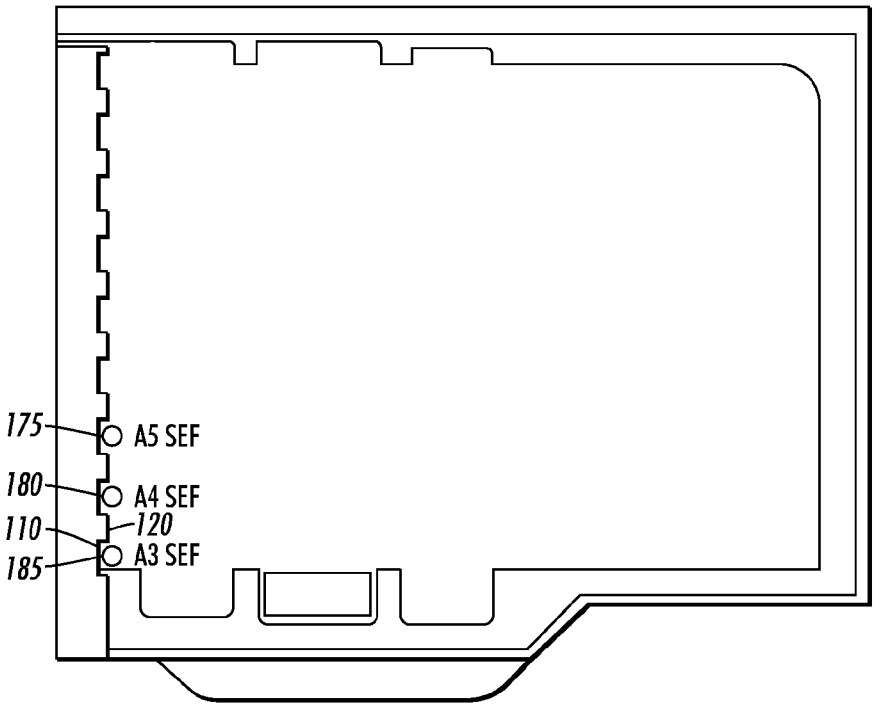
FIG. 5 illustrates an exemplary sheet stacking tray assembly that supports various sheet sizes according to an embodiment.

In an embodiment, one or more edges of the elevate plate 110 may include one or more geometric proturbances 155*a*-N and/or the like. In an embodiment, the protuberances 155*a*-N may extend from a first end 160 of the elevate plate edge to a second end 165 of the elevate plate edge as illustrated by FIG. 1. In an embodiment, the protuberances 155*a*-N of the elevate plate 110 may interfit a complimentary, geometrically formed lead surface 120 as illustrated by FIG. 1. This corresponding configuration may allow the lead surface 120 of the tray 105 to be coupled to the elevate plate 110. As shown by FIG. 5, the lead surface 120 and the elevate plate 110 may interlink to form a support area 170 for one more sheets. For example, the support area 170 may support one or more corners of a stack. In an embodiment, the elevate plate 110 and lead surface 120 may be interlinked during the elevate plate's ascent and decent as illustrated by FIG. 1. In an embodiment, a support area 170 may extend from the lead surface 120 toward the fastening element. In an embodiment, the interlinking between the elevate plate 110 and the lead surface 120 may prevent stack edges from becoming trapped between the tray assembly 100 and the elevate plate 110.

Alternatively, the elevate plate 110 and lead surface 120 may interlink as the elevate plate approaches the top of the lead surface. For example, the elevate plate 110 and lead surface 120 may interlink when the elevate plate reaches a defined height.

In an embodiment, the interlink feature may support the corners of the stack 115 as the last few sheets are fed from the loaded position on the elevate plate 110 to the tray exit ramp and into the feeder. As such, the top sheet of the stack 115 may be fed into the paper path without becoming trapped in the clearance between the tray 105 and the elevate plate 110. As illustrated by FIG. 5, the sheet stacking tray assembly 100 may support various sheet sizes. For example, the sheet stacking tray assembly 100 may support sheet sizes such as A5 SEF 175, A4 SEF 180, A3 SEF 185, Statement SEF, Executive SEF, Letter/Folio/Legal SEF, Letter LEFITAB SEF and/or the like. FIG. 5 depicts the tray's lead surface 120 interlinked with an edge of the elevate plate 110 to support at least one corner of sheet sizes A5 SEF 175, A4 SEF 180 and A3 SEF 185.

Figure 6:
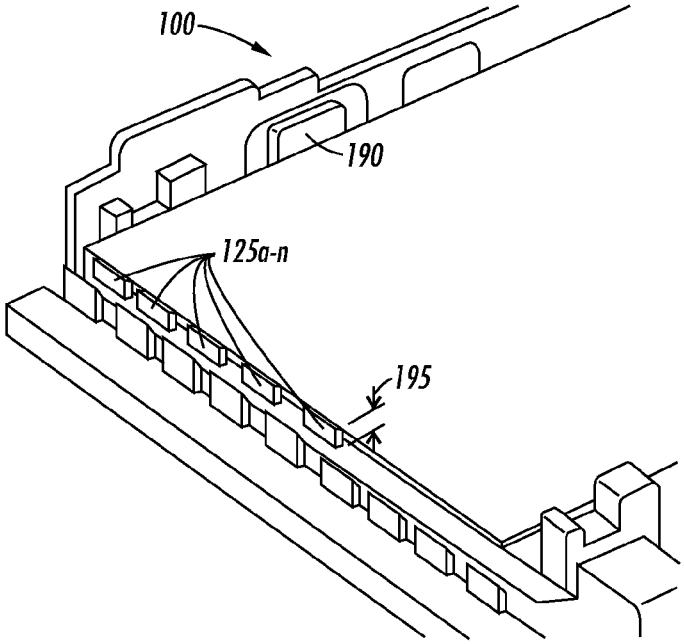
FIG. 6 illustrates an exemplary sheet stacking tray assembly according to an embodiment.

In an embodiment, the height of the protuberances 125*a*-N may be substantially equal to a maximum fill level of the sheet stacking tray assembly 100 as illustrated by FIG. 6. For example, a sheet stacking tray assembly 100 may have a corresponding maximum fill level 190 that may represent the maximum height of a sheet stack that may be properly processed by the resource. If the protuberance height 195 was reduced uniformly, it may be difficult for a customer to register an entire stack against the lead surface. Any sheets above the indentation height may easily become displaced, offset or skewed from the tray registration which may affect the feeding quality and lead to jams.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A sheet stacking tray assembly comprising:

a tray comprising a lead surface, wherein the lead surface comprises one or more first geometric protuberances; and an elevate plate, wherein at least one edge of the elevate plate comprises one or more second geometric protuberances, wherein the second geometric protuberances are complimentary to the first geometric protuberances, wherein the one or more first geometric protuberances and the one or more second geometric protuberances are configured to interlock the lead surface with the edge of the elevate plate such that the elevate plate and the lead surface form a level support area for one or more sheets when the elevate plate is in a raised position.

2. The sheet stacking tray assembly of claim 1, wherein the first geometric protuberances extend from a first end of the lead surface to a second end of the lead surface.

3. The sheet stacking tray assembly of claim 2, wherein the second geometric protuberances extend from a first end of the edge to a second end of the edge.

4. The sheet stacking tray assembly of claim 3, wherein the elevate plate supports a sheet stack, wherein the elevate plate is configured to move vertically relative to the tray to engage a top portion of the sheet stack with a sheet feeder.

5. The sheet stacking tray assembly of claim 4, wherein the elevate plate is configured to pivot about a fastening element, wherein the fastening element is configured to couple the elevate plate to the tray.

6. The sheet stacking tray assembly of claim 1, wherein at least one first geometric protuberance is one of the following:

square-shaped;

triangle-shaped; and circular-shaped.

7. The sheet stacking tray assembly of claim 1, wherein at least one second geometric protuberance is one of the following:

square-shaped;

triangle-shaped; and circular-shaped.

8. The sheet stacking tray assembly of claim 1, wherein the support area is configured to support one or more corners of the one or more sheets.

9. The sheet stacking tray assembly of claim 1, wherein the height of the first geometric protuberances is substantially equal to a maximum fill level associated with the sheet stacking tray assembly.

10. A sheet stacking tray assembly comprising:

a tray comprising a lead surface, wherein the lead surface comprises one or more first geometric protuberances, wherein the first geometric protuberances extend from a first end of the lead surface to a second end of the lead surface; and an elevate plate, wherein at least one edge of the elevate plate comprises one or more second geometric protuberances, wherein the second geometric protuberances extend from a first end of the edge to a second end of the edge, wherein the second geometric protuberances are complimentary to the first protuberances, wherein the one or more first geometric protuberances and the one or more second geometric protuberances are configured to interlock the lead surface with the edge of the elevate plate such that the elevate plate and the lead surface form a level support area for one or more sheets when the elevate plate is in a raised position.

11. The sheet stacking tray assembly of claim 10, wherein the elevate plate supports a sheet stack, wherein the elevate plate is configured to move vertically relative to the tray to engage a top portion of the sheet stack with a sheet feeder.

12. The sheet stacking tray assembly of claim 10, wherein the elevate plate is configured to pivot about a fastening element, wherein the fastening element is configured to couple the elevate plate to the tray.

13. The sheet stacking tray assembly of claim 10, wherein at least one of the first geometric protuberances of is one or more of the following:

square-shaped;

triangle-shaped; and circular-shaped.

14. The sheet stacking tray assembly of claim 10, wherein at least one of the second geometric protuberances of is one or more of the following:

square-shaped;

triangle-shaped; and circular-shaped.

15. The sheet stacking tray assembly of claim 10, wherein the support area is configured to support one or more corners of the one or more sheets.

16. The sheet stacking tray assembly of claim 10, wherein the height of the first geometric protuberances is substantially equal to a maximum fill level associated with the sheet stacking tray assembly.

* * * * *